United States Patent [19]

Pillis et al.

[11] Patent Number: 4,678,406

[45] Date of Patent: Jul. 7, 1987

[54] VARIABLE VOLUME RATIO SCREW COMPRESSOR WITH STEP CONTROL

[75] Inventors: Joseph W. Pillis, Hagerstown, Md.; David A. Murphy, Chambersburg, Pa.; Peter C. Spellar, Hagerstown, Md.; Paul Nemit, Jr., Waynesboro, Pa.

[73] Assignee: Frick Company, Waynesboro, Pa.

[21] Appl. No.: 855,676

[22] Filed: Apr. 25, 1986

[51] Int. Cl.[4] ..... F04B 49/02

[52] U.S. Cl. ..... 417/310; 418/201

[58] Field of Search ..... 417/310; 418/201, 203

[56] References Cited

U.S. PATENT DOCUMENTS

| | | | |
|---|---|---|---|
| 3,088,659 | 5/1963 | Nilsson et al. | 418/201 |
| 3,432,089 | 3/1969 | Schibbye | 418/201 |
| 3,549,280 | 12/1970 | Linneken | 418/21 |
| 4,362,472 | 12/1982 | Axelsson | 417/53 |
| 4,388,048 | 6/1983 | Shaw et al. | 417/310 |
| 4,412,788 | 11/1983 | Shaw et al. | 417/788 |
| 4,455,131 | 6/1984 | Werner-Larsen | 418/201 |
| 4,508,491 | 4/1985 | Schaefer | 417/310 |
| 4,516,914 | 5/1985 | Murphy et al. | 417/282 |
| 4,609,329 | 2/1986 | Pillis et al. | 417/310 |
| 4,611,976 | 8/1986 | Laurtiz | 418/201 |

FOREIGN PATENT DOCUMENTS

| | | | |
|---|---|---|---|
| 2119445 | 11/1983 | United Kingdom | 418/201 |
| 2138971A | 10/1984 | United Kingdom . | |

OTHER PUBLICATIONS

"electrical Specials", dated 9/85, 2 pages, excerpt from manual for installation.

*Primary Examiner*—William L. Freeh

*Attorney, Agent, or Firm*—Dowell & Dowell

[57] ABSTRACT

An axial flow helical screw compressor with a slide valve and slide stop mounted end to end in communication with the intermeshing rotors has means for changing the volume ratio during operation by stepwise movement of the slide stop and for changing the capacity during operation in infinitely variable fashion, both in response to system operating conditions. In the event of interference between the movements of the slide stop and slide valve, the components are designed so that the movements of the slide stop overpowers that of the slide valve.

12 Claims, 6 Drawing Figures

VARIABLE VOLUME RATIO SCREW COMPRESSOR WITH STEP CONTROL

BACKGROUND OF THE INVENTION

1. Field of the Invention

This invention relates to helical screw type compressors with axial fluid flow in which means is provided for varying both the internal volume ratio and the capacity.

2. Description of the Prior Art

The U.S. Pat. No. 4,516,914, to Murphy and Spellar, discloses a helical screw type compressor having a slide valve and a slide stop member in which the pressures at the suction and discharge are sensed and corresponding signals are sent to a micro-processor which calculates the system pressure ratio and causes the selective repositioning of the slide valve and the slide stop in accordance with predetermined criteria.

U.S. Pat. No. 3,088,659, to Nilsson et al., discloses a helical compressor having slide valve and slide stop members which can be adjusted for regulating the volume ratio and capacity.

U.S. Pat. No. 3,432,089, to Schibbye, discloses a helical screw compressor having a slidable valve element for adjustment of its capacity.

U.S. Pat. No. 3,549,280, to Linneken, discloses a helical screw compressor having a slide which is connected to a pressure equalization piston which is charged by the exit or inlet pressure of the pump medium in a direction opposite to the charging of the slide.

U.S. Pat. No. 4,362,472, to Axelsson, discloses a helical compressor in which the opening of the outlet port is controlled in order to control the volume ratio.

U.S. Pat. No. 4,388,048, to Shaw et al., discloses a helical screw compressor in which two end-to-end pistons are used to provide stepwise control of capacity. U.S. Pat. No. 4,412,788 Shaw et al., is another in which the capacity is controlled by controlling the movement of a slide valve.

U.S. Pat. No. 4,455,131, to Werner-Larsen, discloses a helical screw compressor in which the valve member is formed in three parts instead of two as in the U.S. Pat. No. 3,088,659, to Nilsson.

U.S. Pat. No. 4,508,491, to Schaefer, discloses a helical screw compressor having a capacity control slide valve and a modular unloading assembly which is integral with the compressor hermetic casing.

British Pat. No. 2,138,971A discloses a helical screw compressor in which the volume ratio is varied by a valve which is operated in response to the ratio of outlet and inlet pressure acting on a control valve.

SUMMARY OF THE INVENTION

The present invention is directed to step control means for varying the internal volume ratio of a helical screw compressor in response to discharge pressure levels and at the same time varying the capacity of the system in response to suction pressure levels.

It is known that a rotary screw compressor whose volume ratio can be adjusted during operation offers numerous advantages when compared to fixed volume ratio compressors. The most obvious benefit is reduced power consumption and improved energy efficiency, particularly when applied to systems where the suction and discharge pressure levels may be subject to change from time to time. Thus, operating conditions such as the load, the ambient temperature, starting, and the like may affect the condensing pressure and hence, the discharge pressure external to the compressor.

With low discharge pressure conditions, there is a correspondingly low requirement for the volume ratio. At the same time, the suction pressure may have become lower than necessary indicating that unloading of the compressor is desirable.

While it is recognized that infinitely variable volume ratio control gives the best performance under all conditions, it also adds to the cost of the system due to its required complexity. For example, in Murphy et al. U.S. Pat. No. 4,516,914, a system of this kind is described in which the pressures sensed are fed into a micro-computer for controlling the movement of the slide stop and slide valve. In a large compressor, the additional control cost may be justified in savings in power. However, as the compressor size is reduced, the control costs remain relatively constant, thus becoming harder to justify based on reduced power consumption. This is because the total power consumption of a smaller compressor is lower and the incremental improvement possible with infinitely variable volume ratio over stepped variable volume ratio is lower.

The present invention provides a mechanism and control means for providing a helical screw compressor with stepped volume ratios which can be automatically adjusted during operation to the most efficient of the available steps. At the same time, the control system provides infinitely variable capacity control.

The advantages of the foregoing include the relative simplicity of the system because it is not necessary to incorporate feedback mechanism into the movable slide stop mechanism.

The controls in the present system are based on any of several known models between pressure ratio and volume ratio for any given gas. One typical relationship varies for different gases according to the ratio of specific heats, or K value. It, therefore, follows that knowing the gas being compressed, for any given value of suction pressure, it is possible to determine the correct value or values of discharge pressure to produce the desired pressure ratio or ratios for appropriate adjustment of the volume ratio control, or the slide stop. One method of achieving such adjustment is to provide two pressure switches connected to the compressor discharge pressure, and set to operate at different levels of pressure.

Knowing the controlled value of suction pressure, as determined by the set points of capacity control pressure switches, the appropriate set points of volume ratio control pressure switches can be determined. This can be accomplished by calculation or by reading a chart where the results of the predetermined calculations are listed for a given gas with suction pressure (and/or equivalent saturated temperature) comprising one axis of the chart and the correct discharge pressure switch settings comprising the other. If, for any reason, the capacity control pressure switches are adjusted to obtain a new controlled suction pressure, the volume ratio control pressure switches may then be adjusted to their new correct and corresponding values.

DESCRIPTION OF THE PREFERRED EMBODIMENT

Figure 1:
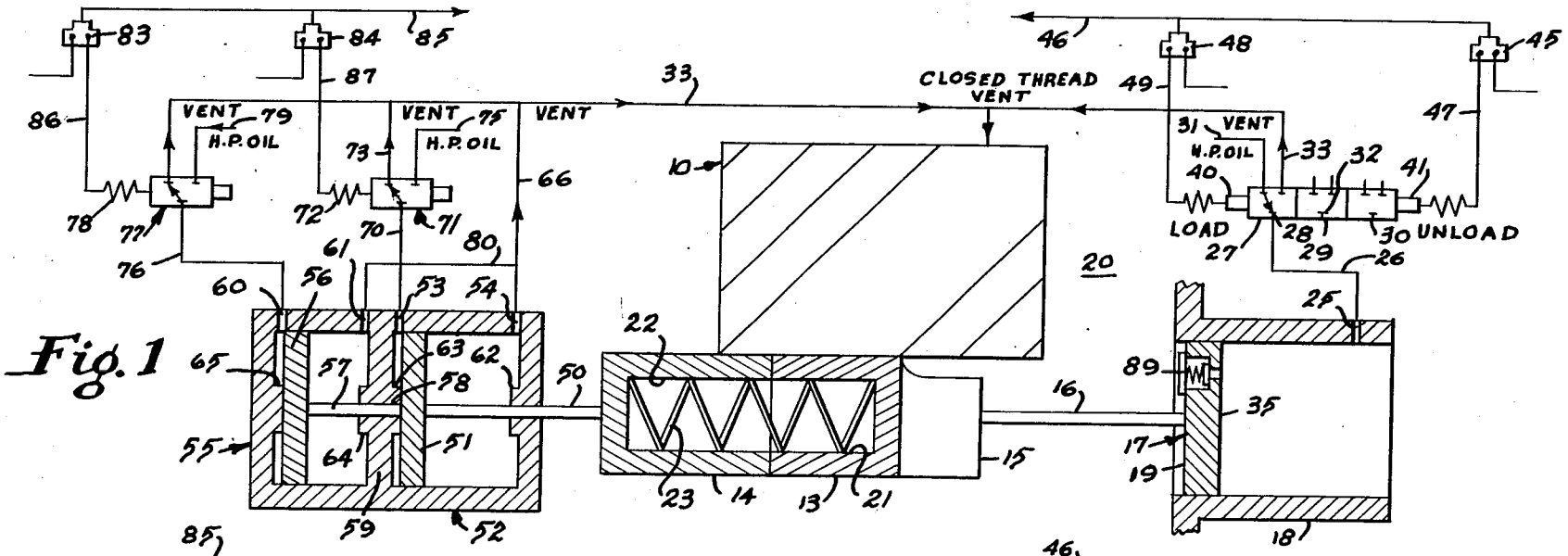
FIG. 1 is diagrammatic view of a helical screw compressor having an axially movable slide valve and slide stop and having control means in accordance with the present invention, and illustrating the slide valve and slide stop in the fully loaded position and at the lowest volume ratio.

With further reference to the drawings, there is illustrated a double helical screw compressor of conventional design using male and female rotors 10, well known in the art. The rotor casing has intersecting bores providing a working space for the intermeshing rotors which are mounted for rotation about their parallel axes. Beneath the rotor bores are a slide valve 13 and a slide stop 14 which are axially movable in the same bore beneath and parallel to the rotor axes. This structure is generally similar to that disclosed in FIG. 8 of the U.S. Pat. No. 3,088,659 to Nilsson et al. and also in the U.S. Pat. No. 4,516,914 to Murphy et al.

Capacity Control

The outer face 15 of the slide valve 13 is connected by a rod 16 to a piston 17 which is received within a cylinder 18. The inner face 19 of the piston 17 is exposed to the pressure within the discharge area 20 of the compressor, as is the face 15 of the slide valve 13.

The slide valve 13 and slide stop 14 have internal coaxial bores 21 and 22 which receive a spring 23 which tends to separate the slide valve and the slide stop.

The cylinder 18 has a port 25 connected to a conduit 26 which is connected to a three-way control valve 27. The valve 27 is shiftable to provide ports 28, 29 and 30 for connection respectively to a conduit 31 from a high pressure oil source, to a hydraulic lock 32, or to a vent 33.

The diameter of piston 17 is such that the combination of the net discharge gas pressure in the area 20 pushing on the piston 17 and the force of spring 23 combine to overpower the discharge gas pressure acting on the outer face 15 of the slide valve 13 when the low pressure vent is connected through port 25 into the cylinder 18, communicating with face 35.

After the compressor is operating and producing a pressure differential, the slide valve 13 can be moved to the left, as indicated in FIG. 1, by shifting the position of the three-way valve in order to apply high pressure oil to the cylinder 18. Ordinarily, oil at discharge pressure or higher is used as the high pressure oil supply. The application of such pressure to the port 25 of the cylinder 18 essentially balances the discharge pressure on the face 19 of the piston 17 so that the piston, itself, has no net force acting on its faces, ignoring the rod area 16. This permits the discharge pressure acting on the face 15 of the slide valve 13 to overcome the spring 23 and push the slide valve to the left in order to move the slide valve into contact with the slide stop and thus load the compressor.

In order to control the position of the three-way valve 27, solenoids 40 and 41 are provided. The energizing of solenoid 40 moves the three-way valve 27 to the left, thereby connecting the high pressure oil line 31 through the valve position 28 to the conduit 26 into the cylinder 18.

Figure 4:
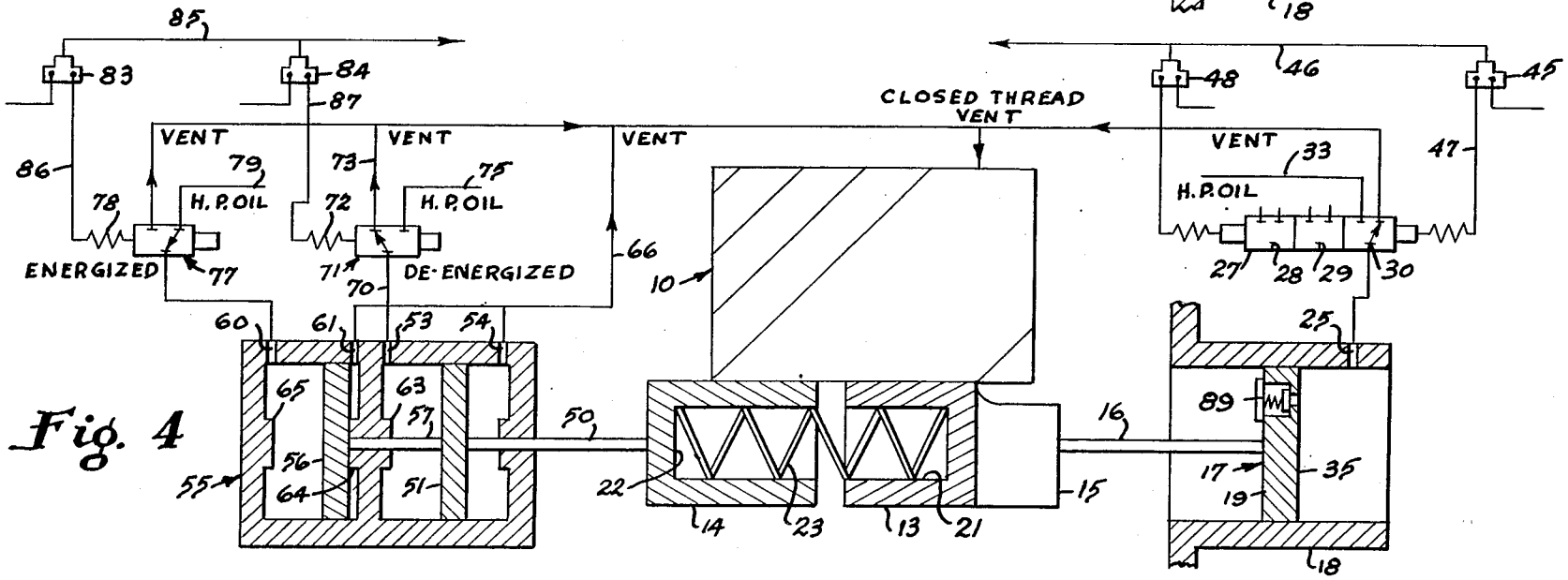
FIG. 4 is a view similar to FIG. 2 in which the slide valve and slide stop are indicated as separated, or in other words, in the partially unloaded position.

If the solenoid coil 41 is energized, coil 40 being deenergized, the three-way valve 27 is moved to the right position in which the conduit 26 from the cylinder 18 is connected to the vent line 33, position 30, as illustrated in FIG. 4. This reduces the pressure on the side 35 of the piston 17 thereby permitting the pressure in the space 20 to move the piston to the right, and hence to move the slide valve 13 away from the slide stop 14. This opens a recirculation gap between the mating edges of the slide valve and slide stop so that a portion of the trapped suction charge is then bypassed through the gap, through internal port areas and back to the suction of the compressor, thereby unloading the compressor.

Valve 27 also has an intermediate position to which it returns automatically when neither of the solenoids 40 or 41 is energized. In this intermediate position, the line 26 from the cylinder 18 is connected to a portion of the valve 27, position 29, which prevents flow or, in other words, provides a hydraulic lock.

In order to provide the controls for the capacity control valve 27, a pressure switch 45 is connected to the suction line 46 and controls the solenoid 41 through an electric lead 47. Similarly, a pressure switch 48 is connected to the suction line 46 and controls the solenoid 40 by electric lead 49.

In a typical refrigeration application, the compressor is selected and operated to maintain a certain pressure level on the suction side of the compressor. Pressure switch 45 would be set at the lowest desired pressure and would energize coil 41 of valve 27 if the suction pressure goes below the low set point, in order to unload the compressor. Similarly, pressure switch 48 would be set to the highest desired suction pressure and when the pressure exceeds this set point, the switch would energize coil 40 of valve 27, thereby loading the compressor.

Volume Ratio Control

Referring to the other end of the compressor, the movable slide stop 14 is connected by a rod 50 to a piston 51 which is mounted within an enclosed housing 52. Housing 52 has a port 53 at its outer end on one side of the piston 51 and a port 54 at its inner end on the other side of the piston 51. A second cylinder housing 55 immediately outboard of the housing 52 receives a piston 56 which is connected to a rod 57 that passes through a bore 58 in the common wall or bulkhead 59 separating the piston housings 52 and 55. The housing 55 has a port 60 on one side of the piston 56 and a port 61 on the other side.

Piston housing 52 has an inboard stop 62 and an outboard stop 63 while piston housing 55 has an inboard stop 64 and an outboard stop 65. The stop locations and the thickness of the pistons are designed to give an appropriate stroke length, to position the slide stop at the desired volume ratio.

In piston housing 52, the port 54 is connected by line 66 to the vent line 33. The port 53 is connected by line 70 to the valve 71 which is controlled by solenoid 72. The valve 71, when it is not energized by the solenoid 72, is connected by line 73 to the vent line 33. However, when the solenoid 72 is energized, the line 70 is connected through the valve 71 to the high pressure oil line 75.

Referring to the cylinder 55, the port 60 is connected by line 76 to the solenoid valve 77 which is controlled by solenoid 78. When the solenoid is not energized, the line 76 is connected through the valve 77 to the vent line 33. However, when the solenoid 78 is energized, then the line 76 is connected to the high pressure oil line 79. The port 61 is connected by line 80 to the vent line 66.

Control of the valves 77 and 71 by the solenoids 78 and 72 is accomplished by pressure switches 83 and 84 respectively, the switches being connected to the pressure discharge line 85 and being connected by wires 86 and 87, respectively, to the solenoids. The pressure switches 83 and 84 are set to operate at different pressures, the switch 83 being set to energize the solenoid 78 at a lower pressure than the pressure switch 84.

All of the pressure switches described herein, numbered 45, 48, 83 and 84, preferably have a built-in differential. That is, the value at which their electrical contacts change state on rising pressure is different from the value at which the same contacts return back to their former state on falling pressure, thus avoiding excessive contact actuation and deactuation. This differential may be adjustable or fixed.

The present invention contemplates the operation of the system as described for controlling the volume ratio of the system in three steps. Referring to FIG. 1, the movable slide stop is shown in its minimum or lowest volume ratio position, say 2.2 Vi.

The solenoids 72 and 78 are deenergized so that the valves 71 and 77 are in the positions indicated in FIG. 1. In such position, the lines 70 and 76 on the outboard sides of the pistons 51 and 65 are connected to the low pressure vent line 33. With this arrangement, the spring 23 within the slide valve and slide stop provides sufficient force to overcome friction in both cylinders 52 and 55 thereby forcing both pistons 51 and 56 to their outboard position as indicated in FIG. 1. This places the slide stop in such a position that the radial port of the slide valve establishes the correct discharge port location for the desired 2.2 full load volume ratio.

Figure 2:
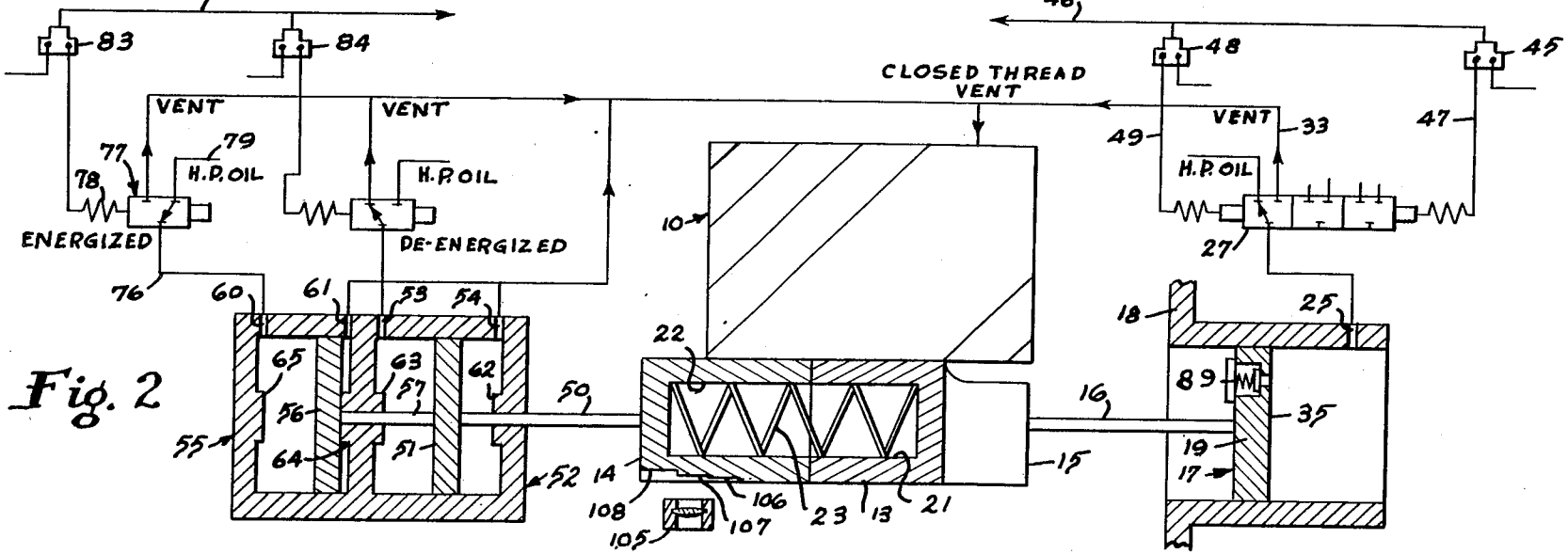
FIG. 2 is a view similar to FIG. 1 in which the slide valve and slide stop are illustrated in intermediate volume ratio position.

FIG. 2 shows the movable slide stop in the intermediate volume ratio position, say 3.5. In this position, solenoid 78 of the valve 77 is energized to connect high pressure oil to the port 60 of the stepping piston cylinder. It is important that the piston area of piston 56 must be large enough so that when hydraulic pressure is applied thereto, the force is sufficient to overpower piston 17 with the high pressure oil in cylinder 18 combined with the force balance created by discharge pressure gas acting on the face 15 of the slide valve and the inboard side of piston 17.

Figure 3:
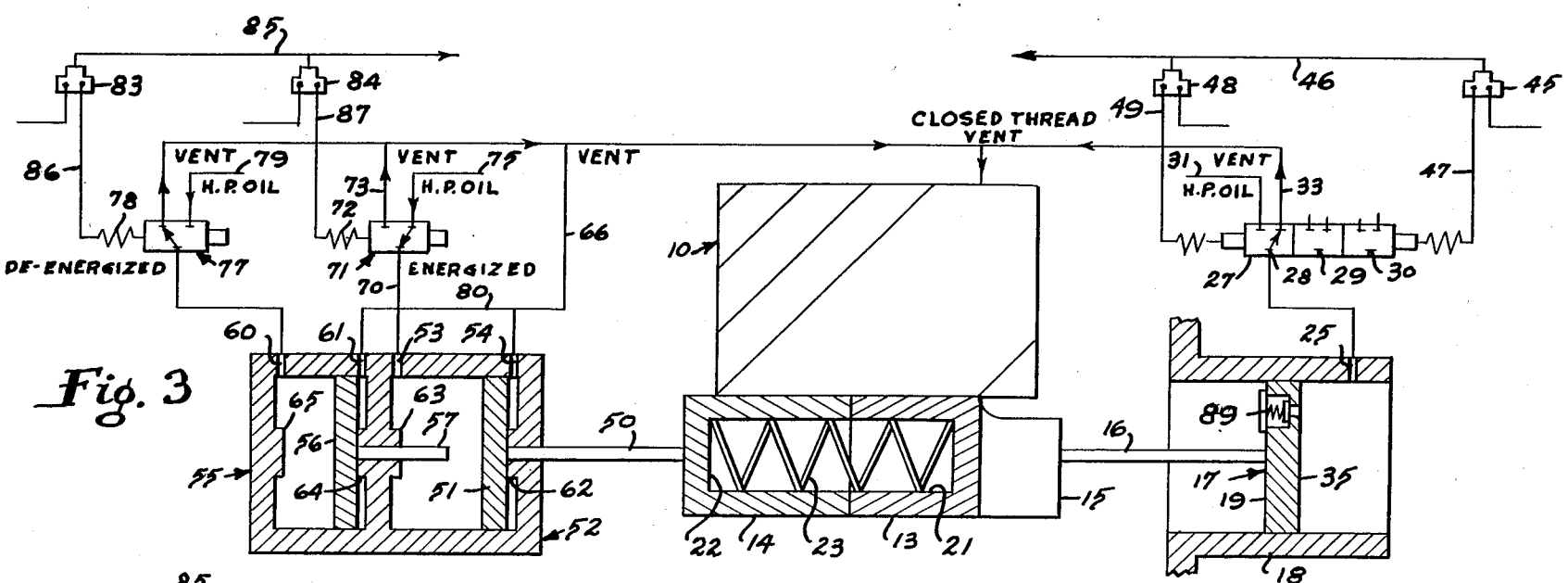
FIG. 3 is a view similar to FIG. 1 in which the slide valve and slide stop are indicated in the highest volume ratio position.

It will be observed that if the valve 27 to which cylinder 18 is connected by line 26 is in the hydraulically locked position that incompressible oil in cylinder 18 would prevent the movement to the right of the cylinder 17 to the position of FIG. 3 if no relief were present in valve 17. However, usually when the facing edges of the slide valve and slide stop are in abutting relationship, the suction pressure is above the high pressure set point as controlled by the pressure switch 48. Should the pressure switch 48 be energized, it actuates solenoid 40 to direct the high pressure oil to the cylinder 18 thereby moving the valve 27 out of the hydraulically locked position. As long as cylinder 18 is exposed to the high pressure oil supply at the same time that cylinder 55 is exposed to the same high pressure oil at port 60, only the relationship of the piston areas will determine which cylinder will overpower the other. Thus, in order to assure proper operation of this feature of the system, the diameter of piston 56 must be carefully selected to assure it will generate the controlling force.

In the event that the suction pressure is between the low and high pressure set points established at the switches 48 and 45, and that the cylinder is under hydraulic lock, means is provided to assure that the volume ratio can still be increased. Thus, the piston 17 is indicated as provided with a spring loaded pressure relief valve 89. In use, whenever the valve 77 or 71 is in position in which high pressure oil is supplied to either of the pistons 56 or 51, and the cylinder 18 is hydraulically locked, the force pushing on piston 17 through the slide valve assembly will raise the pressure of the oil in cylinder 18 until it is above the level of discharge pressure in the discharge area 20. This will overcome the light spring force in the relief valve 89 and allow oil to escape from within the cylinder 18 to the discharge area 20 until the slide stop piston contacts its internal stop (either stop 62 or stop 63).

FIG. 2 also illustrates an optional sight glass 105 that may be positioned in the barrel of the housing immediately radially outwardly of steps 106–108 formed in the body of the slide stop to provide a visual indication of the Vi position of the slide stop.

FIG. 3 illustrates the movable slide stop in the position of the highest volume ratio, say 5.0. In this position, the solenoid 72 is energized to move the valve 71 to apply high pressure oil to the port 53 of the cylinder 52. As in the previous case, proper sizing of piston 51 will assure that it can overpower the force transmitted through piston 17 from the cylinder 18 in combination with the force balance between the slide valve and the inboard side of piston 17. The position of piston 56 is of little consequence in this position as the abutting end of connecting rod 57 is no longer in contact with piston 51. However, for simplicity of control, it will be preferred if piston 56 remains actuated to the right.

Volume Ratio Control at Less Than Full Capacity

In the event that the compressor is operating at less than full capacity, that is with the facing ends of the slide valve and slide stop out of contact with each other so that there is a space therebetween, as discussed above, it is still possible for the slide stop to adjust into any of the three step positions. Thus, assuming that there is a gap between the back edge of the slide valve and the front edge of the slide stop, as indicated in FIG. 4, and that the slide stop is being moved to the position of increasing volume ratio, it will be apparent that only the force of the spring need be overcome by the force exerted on the piston 56. This is easily accomplished by providing a spring which is no larger than necessary and such that it generates less force than the piston at the lowest normally encountered pressure differential between the high pressure oil supply and the vent pressure.

Assuming that the Vi is increasing one step, say from 3.5 to 5.0 Vi, and that the back edge of the slide valve contacts the front edge of the slide stop before the piston 51 engages its stop 62, it must also be noted that the load on the suction of the machine was not large enough to require the maximum capacity of the compressor. As the piston 51 moves to the right, the recirculation gap between the slide valve and slide stop narrows. Presumably, the compressor will then be drawing in too much suction charge and the suction pressure will begin to pull down. Once it pulls down below the pressure set point at the pressure switch 45, the pressure switch 45 will operate to energize the solenoid 41 thereby opening the vent to the cylinder 18 and causing it to move to the right thereby permitting the piston 51 to continue travelling until it contacts its stop 62. Piston 17 will then continue to move to the right unloading the compressor until suction pressure begins to climb above the low pressure set point for which the switch 45 is set.

Decreasing Volume Ratio

The volume ratio can be decreased from high to low in stepwise manner by actuating the solenoid valves 71 and 77 as discussed above. For example, to reduce the Vi from maximum to intermediate, the solenoid 78 for valve 77 is energized to connect high pressure oil to the space outboard of piston 56; and solenoid 72 for valve 71 is deenergized to connect vent line 33 to the space outboard of piston 51. Under this condition, the force of the spring 23 must be adequate to overcome the friction of the piston 51 in order to force it back against the abutting end of the rod 57, thus establishing the movable slide stop at the intermediate Vi position. Reduction of the Vi from the intermediate to the minimum position requires that the spring 23 must be strong enough to overcome the friction involving both pistons 51 and 56 in order to force them both to the lowest Vi position.

Figure 5:
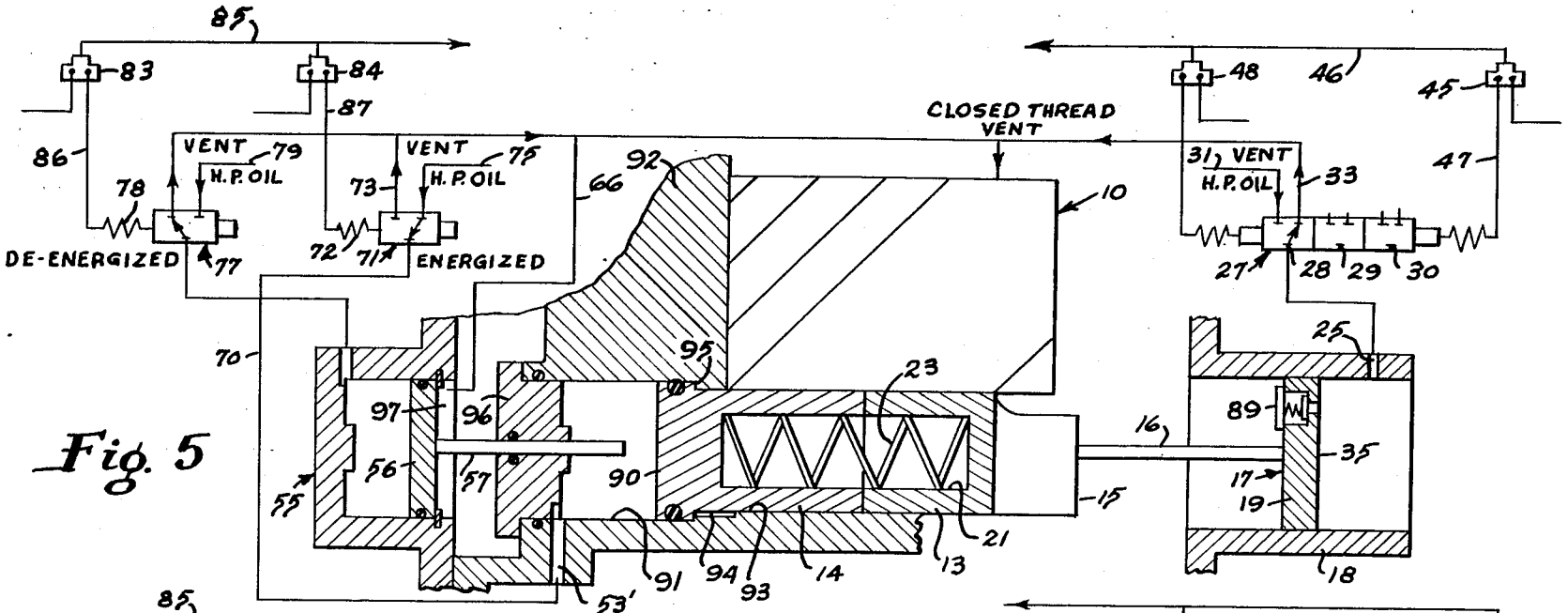
FIG. 5 is a view similar to FIG. 1 of a modified form of slide stop mechanism, and, FIG. 6 is a view similar to FIG. 1 of a further modified form of slide stop mechanism.

Modification of FIG. 5

Various modifications of piston structure may be employed. In FIG. 5, instead of having a rod and piston connected to the outboard end wall of the slide stop, as in the preceding description, the slide stop 14' has a piston head 90 received within the bore 91 of the housing 92. Bore 91 is larger than bore 93 carrying the main body of the slide stop 14'. The space 94 which is forward of the piston head 90 is vented to the inlet suction or other low pressure area. In the portion of the slide stop 14' indicated in FIG. 5, the slide stop is at maximum Vi, the piston head then being in engagement with the stop portion 95 of the bore.

Outwardly of the slide stop 14', the bore 91 is terminated by a bulkhead 96, corresponding to the bulkhead 59 in the previous description. The bulkhead slideably receives the rod 57 having the piston 56 which is moveable within the housing 55. The solenoid controlled valve 71 has a line 70 that is connected to the port 53' in the housing wall inwardly of the bulkhead 96. The space 97 between the bulkhead and the piston 56 is connected by line 66 to the vent line. Operation of this modification is similar to that of the embodiment of FIGS. 1–4, with the piston head 90 substituted for the piston 51 and rod 50.

Figure 6:
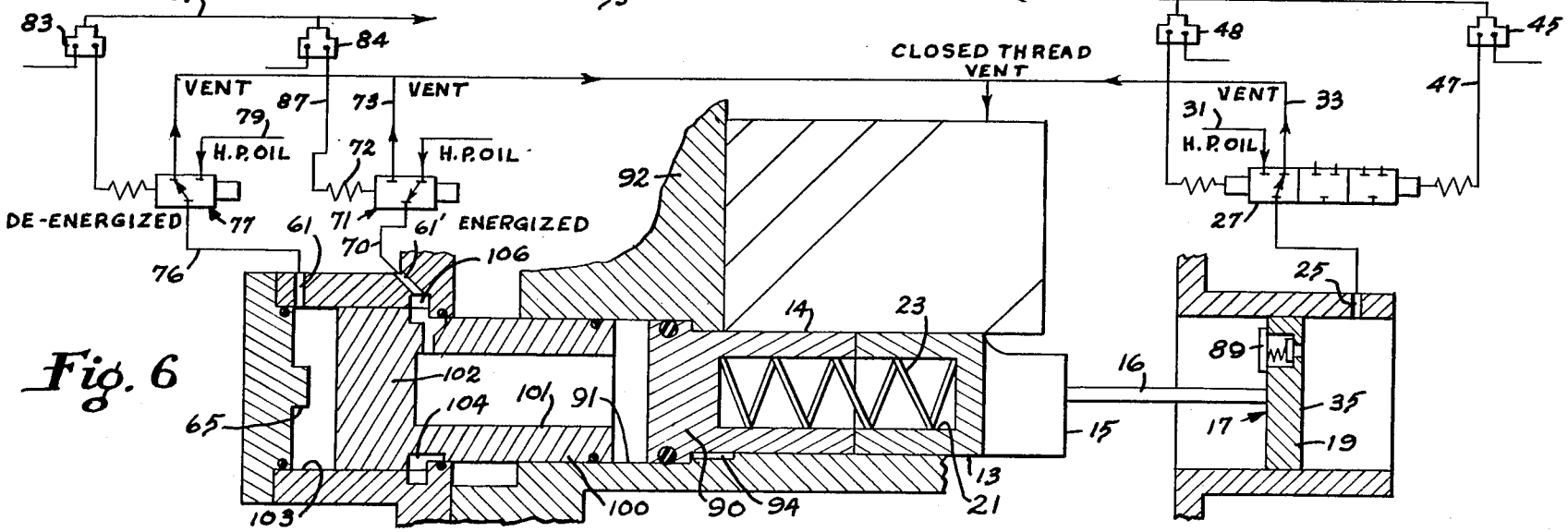

Modification of FIG. 6

In FIG. 6, instead of using rods and pistons separated by a bulkhead, a combined structure is employed. Thus, a slide stop with a piston head 90 is employed as in FIG. 5. However, the rod, piston, and bulkhead arrangement of FIG. 5 are not used. Instead, a hollow piston 100 having a cavity 101 opening towards the slide stop, and a piston head 102, at its opposite end, is used. Piston head 102 is received within the bore 103 which is larger than the bore 91 carrying the main body of the piston 100. The annular space 104 which is forward of the piston head 102, communicates with the line 70 through the vent 61'. The piston is moveable between the positions at which its head engages the outboard stop 65 and the stop portion 106 of the bore.

In operation, when the slide stop is at minimum Vi, the piston 100 is at the extreme outboard position against the stop 65. To move to the next higher Vi position, high pressure air is passed through line 76 and vent 61 into the space outboard of piston head 102. At the same time, the annular space 104 is connected by vent 61', line 70, and valve 71 to vent 73 through solenoid valve 71. This moves the piston 100 to the position of FIG. 6.

In order to move the slide stop 14 to the next higher Vi position, high pressure oil is passed through line 70, vent 61', and space 104 into the cavity of piston 100. This acts against the outboard side of piston head 90 of the slide stop to urge it to the right, as shown in FIG. 6.

Example of Component Dimensions

Reference has been made above to the necessity for sizing the components including the slideable valve members, the pistons, and the spring in order that the slide valve and slide stop may move as required in response to the pressures to which they are selectively exposed.

By way of example, only, the following is illustrative of a working example.

Assume: $P$ discharge = $P$ $HP$ oil = 200 psia $P$ suction = 50 psia $P$ vent = closed thread pressure = 1.2 $P$ suction = 1.2 × 50 psia = 60 psia.

Area: Piston 17 (right face) = 6.5 sq. in.

Rods 16, 50, 57 = 0.44 sq. in.

Piston 17, left face (net) = 6.06 sq. in.

Slide Valve 13, right face(net) = 4.56 sq. in.

Slide Valve 13, left face = 5.00 sq. in.

Slide Stop 14, right face = 5.00 sq. in.

Slide Stop 14, left face (net) = 4.56 sq. in.

Piston 51, 56, right face (net) = 6.06 sq. in.

Piston 51, 56, left face = 6.5 sq. in.

Assume Spring 23 has force of 50 lbs.

Assume cylinder 18 open to *vent* and right face of slide valve and left face of piston 17 exposed to discharge. Then, forces urging slide valve 13 to *right:*

$$6.06(200)+5.00(50)+50=1212+250+50=1512 \text{ lbs. force;}$$

forces urging slide valve 13 of *left:*

$$6.50\ (60)+4.56\ (200)=390+912=1302 \text{ lbs. force.}$$

Net force urging slide valve 13 to right=210 lbs. force. This is adequate to move slide valve 13 in unloading direction.

Assume slide stop 14 is to be moved to left to reduce Vi. Assume slide stop and slide valve are separated. Then, the forces urging slide stop to *left:*

$$50\ (\text{spring})+5(50)+6.06(60)=50+250+364=664$$

The forces urging slide stop to right:

$$4.56(50)+6.5(60)=228+390=618$$

Here the use of the 50 lb. spring assures that the forces urging the slide stop to the *left* are adequate to overcome friction and the 4 lb. net load.

Assume it is desired to move slide stop 14 to the *right* to increase Vi, by applying high pressure to piston 51. The net force acting on piston 51 urging it to the *right* is:

$$6.5(200)-6.06(60)=1300-364=936\ \text{lb.}$$

At part load, i.e. with a gap between slide valve 13 and slide stop 14, the piston force must overcome the 50 lb. spring, the rod area difference (0.44 sq. in.) at suction pressure, ($0.44\times 50=22$ lb.) and friction, a total of 72 lb.+friction. The 936 lb. is adequate.

At full load, i.e. contact between slide valve 13 and slide stop 14, the forces urging the slide stop and slide valve to the *right:*

$$6.06(200)+4.56(50)+6.5(200)=1212+228+1300=2740.$$

The forces urging the slide stop and slide valve to the *left:*

$$6.5(200)+4.56(200)+6.06(60)=1300+912+364=2576\quad 2740-2576=164\ \text{lb.}$$

The net force of 164 is reduced by the force required to open the check valve 90. The check valve is assumed to have a pressure drop across it of 1 psia. Thus, the net force is reduced to $164-6.5=157.5$ lb.

The foregoing net force is adequate to overcome friction.

The sizing of piston 56 would be the same as for piston 51. However, it must overcome its own additional friction. The resultant forces indicated above are adequate for this purpose.

While the foregoing examples do not include all possible operating conditions, they are viewed as sufficiently illustrative to show the methods of piston sizing and the feasibility of the concepts.

What is claimed is:

1. In a screw compressor having meshing helical rotors on parallel axes and mounted in a housing having intersecting cylindrical bores, a high pressure end wall at one end of said housing and a low pressure end wall at the other end thereof, the low pressure end wall having an inlet opening for the inlet of the compressor and the high pressure end wall having a discharge opening for the outlet of the compressor, an axially extending recess in the housing in open communication with said bores and with the inlet opening, a slide valve member mounted for axial movement in the recess, said slide valve member having an inner face in sealing relationship with said rotors, said slide valve member having a discharge face at one end thereof which is adjacent to the high pressure end wall containing a radial discharge port opening and having a rear face at its other end, and a slide stop member mounted for axial movement in said recess, said slide stop member having an inner face in sealing relationship with said rotors, said slide stop member having a front face, the slide stop front face being adapted to engage the slide valve member rear face to form a continuous composite member which is selectively operative to close the axially extending recess to the inlet opening, said slide valve member and slide stop being movable apart to provide an opening therebetween of variable selected size and axial position in communication with the inlet opening, the improvement comprising, said slide valve member having first piston means,
said first piston means received in a first cylinder,
high pressure means,
low pressure means,
the outer face of said first piston means communicating with said high pressure means,
first valve means,
first conduit means from said first valve means to said first cylinder,
said first valve means having selective means to connect said conduit means, alternatively, to said high pressure means, to a closed passage, or to said low pressure means,
actuating means for said first valve means, means responsive to the pressure at the inlet opening and operative to control said actuating means,
said slide stop member having second piston means, said second piston means received in a second cylinder having first and second spaced ports on opposite sides of said second piston means,
second valve means,
second conduit means from said second valve means to said first port of said second cylinder,
said second port of said second cylinder communicating with said low pressure means,
said second valve means having selective means to connect said second conduit means, alternatively, to said high pressure means or to said low pressure means,
actuating means for said second valve means, and means responsive to the pressure at the discharge opening and operative to control the actuating means for the second valve means.

2. The invention of claim 1 in which the means responsive to the pressure at the discharge opening and operative to control said actuating means comprises pressure switch means having differential pressure means.

3. The invention of claim 1, in which the means responsive to the pressure at the inlet and discharge openings and operative to control said actuating means comprises switch means responsive to the pressures, said switch means operating within predetermined pressure limits.

4. The invention of claim 1, said slide stop member having an outer body portion having indicia extending longitudinally, and viewing means mounted in said housing overlying said outer body portion having the indicia whereby an observer may view the indicia and determine the axial position of said slide stop member.

5. The invention of claim 1, in which said second piston means has a head, the central portion of which is an integral extension of the slide stop member.

6. The invention of claim 1 in which the means responsive to the pressure at the inlet opening and operative to control said actuating means comprises high and low limit pressure switch means.

7. The invention of claim 1, and third piston means, said third piston means received in a third cylinder having first and second spaced ports on opposite sides of said third piston means, said third piston means having means operative to engage said second piston means, third valve means, third conduit means from said third valve means to said first port of said third cylinder, fourth conduit means from said second port of said third cylinder, said fourth conduit means permitting communication with said low pressure means, said third valve means having selective means to connect said third conduit means alternatively to said high pressure means or to said low pressure means, actuating means for said third valve means, and means responsive to the pressure at the discharge opening and operative to control the actuating means for the third valve means.

8. The invention of claim 7, in which the means responsive to the pressure at the discharge opening and operative to control the actuating means for the third valve means comprises pressure switch means having differential pressure means.

9. The invention of claim 7, and means responsive to a predetermined pressure within said first cylinder for relieving the pressure therein in order to permit said first piston to move inwardly of said cylinder when said first valve means selective means connects said first conduit means to said closed passage.

10. The invention of claim 7, in which said second piston means has a head, the central portion of which is an integral extension of the slide stop member, and in which the third piston means has a hollow cavity in communication with the head of said second piston means.

11. The invention of claim 1, and means responsive to a predetermined pressure within said first cylinder for relieving the pressure therein in order to permit said first piston to move inwardly of said cylinder when said first valve means selective means connects said first conduit means to said closed passage.

12. The invention of claim 11, in which said means for relieving the pressure is a spring biased check valve mounted in said first piston means.

* * * * *